US006086152A

United States Patent [19]

Zeller

[11] Patent Number: 6,086,152

[45] Date of Patent: Jul. 11, 2000

[54] PORTABLE BACK SUPPORT FOR CHAIRS

[76] Inventor: Louise A. Zeller, 2308 Beach Ave., Spray Beach, N.J. 08008

[21] Appl. No.: 09/073,629

[22] Filed: May 6, 1998

[51] Int. Cl.[7] ..... A47C 7/42

[52] U.S. Cl. ..... 297/284.5; 297/DIG. 6; 297/228.12; 297/230.1; 297/219.1

[58] Field of Search ..... 297/284.5, 230.1, 297/228.12, 219.1, 397, DIG. 6

[56] References Cited

U.S. PATENT DOCUMENTS

| | | | |
|---|---|---|---|
| D. 258,187 | 2/1981 | Robbins . | |
| 3,278,226 | 10/1966 | Magnusson | 297/228.12 X |
| 3,540,776 | 11/1970 | Wilson | 297/284.5 X |
| 3,974,827 | 8/1976 | Bodeen . | |
| 4,036,524 | 7/1977 | Takamatsu | 297/219.1 |
| 4,362,334 | 12/1982 | Ross et al. . | |
| 4,363,517 | 12/1982 | Scott . | |
| 4,512,047 | 4/1985 | Johnson | 297/230.1 X |
| 4,536,028 | 8/1985 | Jones et al. . | |
| 4,541,670 | 9/1985 | Morgenstern et al. . | |
| 4,844,540 | 7/1989 | Pegram . | |
| 4,864,668 | 9/1989 | Crisp . | |
| 4,876,755 | 10/1989 | Parrish | 297/230.1 X |
| 4,908,891 | 3/1990 | Blagg . | |
| 4,934,005 | 6/1990 | Martin et al. . | |
| 4,960,304 | 10/1990 | Frantz . | |
| 5,199,120 | 4/1993 | Holmes . | |
| 5,288,132 | 2/1994 | Vaughn . | |
| 5,297,304 | 3/1994 | O'Sullivan | 297/397 X |
| 5,297,848 | 3/1994 | Grinnell | 297/284.5 X |
| 5,310,245 | 5/1994 | Lyszczasz | 297/397 X |
| 5,314,235 | 5/1994 | Johnson . | |
| 5,324,243 | 6/1994 | Wilkinson . | |
| 5,346,308 | 9/1994 | Buhot et al. . | |
| 5,443,880 | 8/1995 | Wike . | |
| 5,522,793 | 6/1996 | Cohen . | |
| 5,630,651 | 5/1997 | Fishbane | 297/397 |
| 5,642,917 | 7/1997 | Geiger | 297/DIG. 6 X |
| 5,782,531 | 7/1998 | Shindle | 297/228.12 X |

*Primary Examiner*—Peter M. Cuomo
*Assistant Examiner*—Stephen Vu
*Attorney, Agent, or Firm*—Hopgood, Calimafde Kalil & Judlowe, LLP

[57] ABSTRACT

A portable, orthopedic support device suitable is employed for use with conventional out-door furniture such as beach or lounge chairs, and which is designed to provide support to the cervical and/or lumbar regions of the spine.

22 Claims, 3 Drawing Sheets

PORTABLE BACK SUPPORT FOR CHAIRS

FIELD OF THE INVENTION

The present invention relates to peripheral devices for adapting to existing furniture. More particularly, the invention is a portable, orthopedic support device suitable for use with conventional outdoor furniture such as beach or lounge chairs, and designed to provide support to the cervical and/or lumbar regions of the spine.

BACKGROUND OF THE INVENTION

Back pain and discomfort are ubiquitous problems for activities (or inactivities) involving sitting or lounging for extended periods of time. Such pastimes include sunbathing and simply relaxing outdoors on the backyard patio. Extended stay in lounge chairs begins to go against the very purpose of being so situated as back discomfort begins to outweigh the relaxing aspects of that activity. For persons with existing physical conditions involving the dorsal areas of the body, it may not even be a matter of duration, but simply laying back onto a beach chair that causes discomfort. It would be beneficial to the art to have available a device that can be adapted to existing furniture for providing support to the cervical and/or lumbar regions of the spine where most of the above-described back discomfort and pain are localized.

Self-contained, portable back rests are known such as described in U.S. Pat. Nos. 4,363,517 and 4,908,891. These devices are self-contained furniture themselves requiring no adaptations to existing chairs and not of the kind contemplated by this disclosure.

Covers for beach chairs and patio seating are old in the art and some have even been patented. Representative examples include those disclosed in U.S. Pat. Nos. 4,536,028 and 4,844,540. These devices are simply towels or sheets made to fit over their intended seating means.

Other devices for adaptive use with chairs for providing back support are known such as depicted in U.S. Pat. No. Des. 258,187 and described in U.S. Pat. Nos. 3,974,827, 4,362,334, 4,864,668, 5,314,235 and 5,522,793. None of these patents disclose a portable, orthopedic support device suitable for use with conventional outdoor furniture such as beach or lounge chairs and designed to provide support to the cervical and/or lumbar regions of the spine such as provided by the following disclosure.

SUMMARY OF THE INVENTION

The invention is a portable, orthopedic apparatus suitable for use with conventional furniture such as a beach or lounge chair and for providing support to the cervical and/or lumbar regions of the spine. It comprises a cervical support; a lumbar support; a means for joining the cervical support to the lumbar support; a detachable means having a first portion and a second portion, the first portion contiguous with the joining means and the second portion contiguous with the lumbar support; and a first set of attaching means and a second set of attaching means with the first set of attaching means contiguous with the cervical support and the second set of attaching means contiguous with the lumbar support, wherein the first set of attaching means and the second set of attaching means are adapted to engage the furniture in a fixed position.

The lumbar support and the cervical support can, each, be shaped-foam pillows, and the detachable means can comprise mechanically engageable hook and loop fasteners, such as those sold under the brand VELCRO. The attaching means can further comprise a hook and bungee material.

The cervical support engages the neck region of a person laying on the apparatus, the joining means engages the thoracic, mid-back region of the person, and the lumbar support engages the lower back of the person. The attaching means can be elastic devices capable of wrapping around the target furniture, with the first set attaching to a portion of the furniture corresponding to the neck region of a person laying thereto and the second set attaching to a portion of the furniture corresponding to the lower back region of a person laying on the furniture having the present apparatus adapted to it.

The present orthopedic apparatus can also have a carrying means contiguous with the lumbar support wherein the carrying means is adapted to roll-up the apparatus therein for portable transport. The carrying means can further comprise a securing means and at least one handle.

The lumbar support, the cervical support, the joining means, the carrying means and the handle can, each, be made of a durable and weather-resistant material. The securing means can be a conventional zipper, and also be made of a durable and weather-resistant material. Alternatively, the securing means can be a two-sided zipper of like material and the carrying means can be turned inside out for use as a sealable, storage enclosure.

BRIEF DESCRIPTION OF THE DRAWINGS

The above system is more fully understood by referring to the associated figures of which.

DETAILED DESCRIPTION OF THE INVENTION

Figure 1:
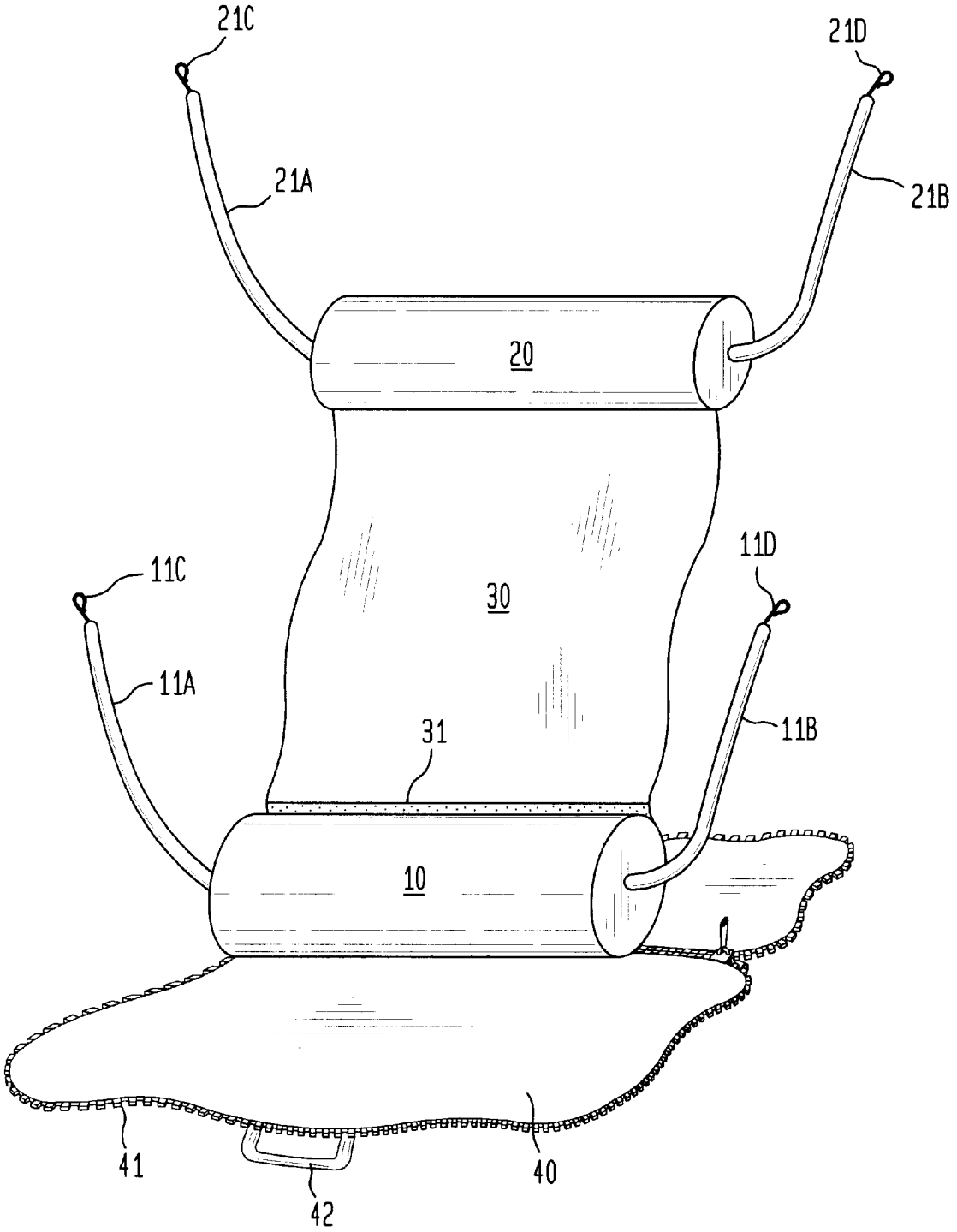
FIG. 1 shows the preferred embodiment of the present invention in the opened state and features the main elements of the invention.

FIG. 1 depicts the preferred embodiment of the present invention in the opened state and features the main elements which are the lumbar support 10, cervical support 20, joining means 30, detachable means 31 and attaching means 11A, 11B, 21A and 21B. Lumbar support 10 is preferably a shaped-foam pillow of durable and weather-resistant construction and is designed to engage the lumbar spinal (lower back) region of a person laying against it.

Lumbar support 10 is joined to cervical support 20 by joining means 30 which is detachable via means 31. Cervical support 20 is also preferably a shaped-foam pillow of durable and weather-resistant construction, and is designed to engage the cervical spinal (neck) region of a person laying against it. Joining means 30 is made of a durable and weather-resistant fabric such as canvas, vinyl or towel material, which fabric also covers lumbar support 10 and cervical support 20, in the preferred embodiment, for aesthetic as well as practical reasons. The specific substrate materials identified are not critical to the invention, and those skilled in the art can readily perceive other suitable and alternative materials after having the benefit of this disclosure.

In the preferred embodiment, detachable means 31 is made of mechanically engageable hook and loop fasteners with corresponding halves attached to lumbar support 10 and joining means 30, respectively. When these elements are joined together, a person using the device engages her lumbar spinal (lower back) region on lumbar support 10, her thoracic (mid to upper back) region on joining means 30, and her cervical spinal (neck) region on cervical support 20. This allows the person to use her weight to press upon the device so that there is no shifting, slipping or blowing away of the device. Alternatively, the two halves of detachable means 31 can be peeled away so that joining means 30 and cervical support 20 are not required nor used on a chair in which the back portion does not extend beyond the shoulder region.

Attaching means 11A and 11B are contiguous with lumbar support 10, while attaching means 21A and 21B are contiguous with cervical support 20. Attaching means 11A, 11B, 21A and 21B are elastic devices capable of wrapping around a target chair and attaching to each other via hooks 11C, 11D, 21C and 21D. Preferably, the attaching means are bungees, but a skilled artisan can substitute other means with equal effect without departing from the scope of the presently disclosed invention.

Figure 2:
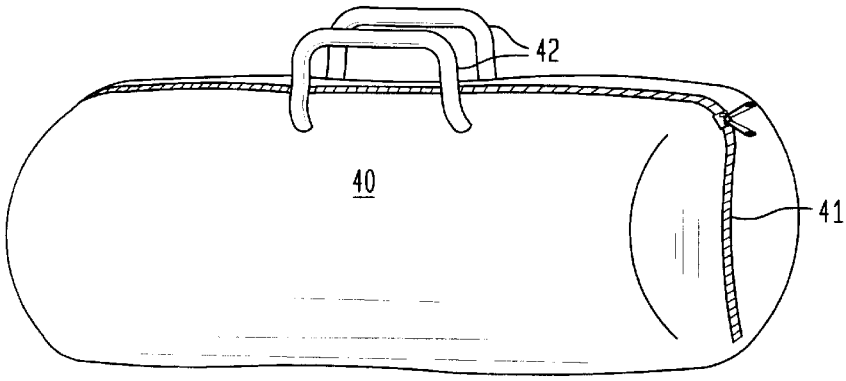
FIG. 2 depicts the embodiment shown in FIG. 1 in its compact, self-contained, portable state.

The entire apparatus can be rolled up and stored in carrying means 40 which features securing means 41 and handle 42 (a pair of handles are depicted more appropriately in FIG. 2). Carrying means 40 and handle 42 can be made of the same fabric as for the construction of joining means 30 and the cover material for lumbar support 10 and cervical support 20 (in the preferred embodiment), again, for aesthetic as well as practical reasons.

Carrying means 40 can be integral to the cover of lumbar support 10 or any other element of the device so that it can be turned inside out for use, then reversed and wrapped around the device for transport. Alternatively, carrying means 40 can be a physically separate element. Securing means 41 can be a conventional zipper and also be made of a durable and weather-resistant material.

Figure 4:
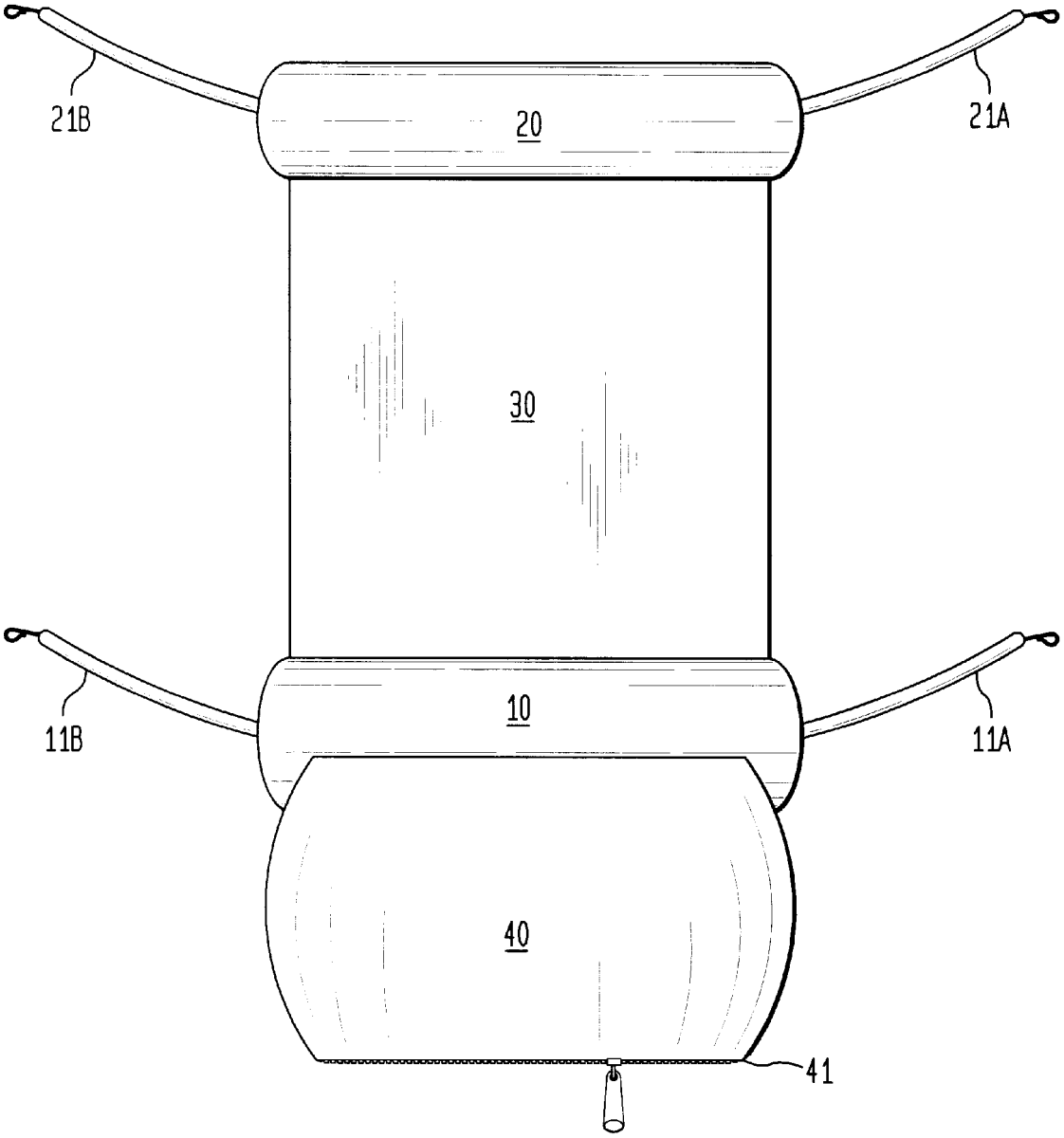
FIG. 4 shows a rear view of one embodiment of the present invention having a carrying means which can be turned inside out for use as a storage area.

The embodiment shown in FIG. 4 has carrying means 40 integral to the cover of lumbar support 10 and securing means 41 is a two-sided zipper of a durable and weather-resistant material. In this configuration, carrying means 40 can be turned inside out for use as a storage area for keys, wallets, suntan lotion and the like sundries. Two-sided zipper securing means 41 can then be zipped up to form a sealed, storage enclosure.

Figure 3:
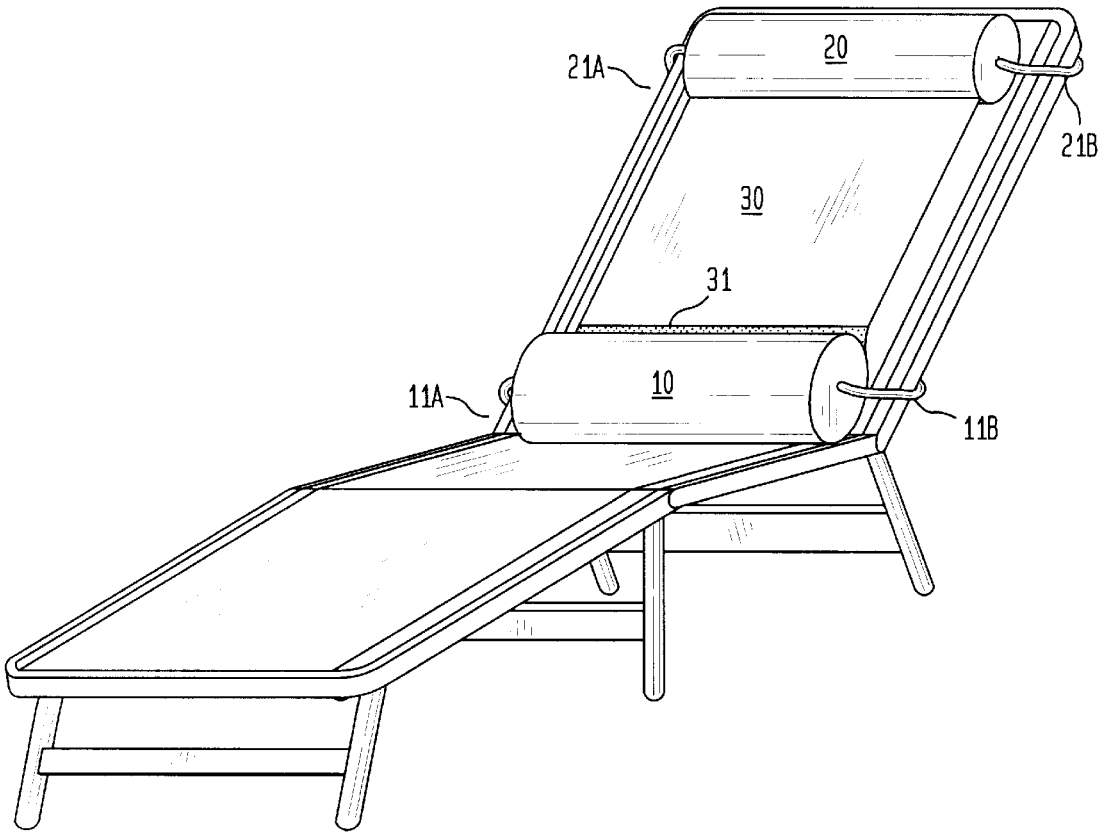
FIG. 3 shows the present invention in place on a beach chair and ready for use.

FIG. 2 shows the embodiment depicted in FIG. 1 in its compact, self-contained, portable state, with securing means 41 shown "zipped up." FIG. 3 shows attaching means 11A, 11B, 21A and 21B wrapped around a chair so that a person who sits on the now-adapted chair will engage her lumbar spinal (lower back) region on lumbar support 10, thereby achieving comfort which would not be available without lumbar support 10. The user's thoracic (mid to upper back) region places weight on joining means 30 and her cervical spinal (neck) region will engage cervical support 20 as attaching means 21A and 21B are wrapped around the chair as shown. Carrying means 40 is tucked behind lumber support 10 and is not visible from the view in FIG. 3. Likewise, hook 11C links up with hook 11D, and hook 21C links up with hook 21D, but are not visible in FIG. 3.

The above-described arrangement is merely illustrative of the principles of the present invention. Numerous modifications and adaptations thereof will be readily apparent to those skilled in the art without departing from the spirit and scope of the present invention.

What is claimed is:

1. A portable, orthopedic apparatus suitable for use with conventional furniture and for providing support to the cervical and/or lumbar regions of the spine of a person, consisting essentially of:

a cervical support;

a lumbar support;

a means for joining said cervical support to said lumbar support and along which said supports can be rolled up;

a means for selectively detaching said joining means from said lumbar support and having a first portion and a second portion, said first portion contiguous with said joining means and said second portion contiguous with said lumbar support, and said means for selectively detaching comprising mechanically engageable paired complementary fasteners; and a first set of attaching means and a second set of attaching means, said first set of attaching means contiguous with said cervical support and said second set of attaching means contiguous with said lumbar support, wherein said first set of attaching means and said second set of attaching means are adapted to engage said furniture in a fixed position.

2. The apparatus of claim 1, wherein each of said lumbar support and said cervical support is a shaped-foam pillow.

3. The apparatus of claim 1, wherein said lumbar support engages the lumbar spinal region of a person laying against said lumbar support.

4. The apparatus of claim 1, wherein said cervical support engages the cervical spinal region of a person laying against said cervical support.

5. The apparatus of claim 1, wherein each of said lumbar support, said cervical support, and said joining means is made of a durable and weather-resistant material.

6. The apparatus of claim 1, wherein said means for selectively detaching is comprised of mechanically engageable hook and loop fasteners.

7. The apparatus of claim 1, wherein said cervical support engages the neck region of a person laying on said apparatus, said joining means engages the thoracic, mid-back region of said person, and said lumbar engages the lower back of said person.

8. The apparatus of claim 1, wherein said attaching means are elastic devices adapted for wrapping around said furniture.

9. The apparatus of claim 8, wherein said attaching means further comprise of a hook and bungee material.

10. A portable, orthopedic apparatus suitable for use with conventional furniture and for providing support to the cervical and/or lumbar regions of the spine of a person, consisting essentially of:

a cervical support;

a lumbar support;

a means for joining said cervical support to said lumbar support and along which said supports can be rolled up;

a means for selectively detaching said joining means from said lumbar support and having a first portion and a second portion, said first portion contiguous with said joining means and said second portion contiguous with said lumbar support, said means for selectively detaching comprising mechanically engageable paired complementary fasteners;

a first set of attaching means and a second set of attaching means, said first set of attaching means contiguous with said cervical support and said second set of attaching means contiguous with said lumbar support; and a carrying means contiguous with said lumbar support, wherein said first set of attaching means and said second set of attaching means are adapted to engage said furniture in a fixed position and said carrying means is adapted to roll-up said apparatus therein for portable transport.

11. The apparatus of claim 10, wherein each of said lumbar support, said cervical support, said joining means and said carrying means is made of a durable and weather-resistant material.

12. The apparatus of claim 10, wherein said carrying means is further comprised of a securing means and at least one handle.

13. The apparatus of claim 12, wherein each of said lumbar support, said cervical support, said joining means, said carrying means and said handle is made of a durable and weather-resistant material.

14. The apparatus of claim 12, wherein said securing means is a conventional zipper made of a durable and weather-resistant material.

15. The apparatus of claim 12, wherein said securing means is a two-sided zipper made of a durable and weather-resistant material.

16. The apparatus of claim 15, wherein said carrying means can be turned inside out for use as a sealable, storage enclosure.

17. The apparatus of claim 10, wherein said lumbar support engages the lumbar spinal region of a person laying against said lumbar support.

18. The apparatus of claim 10, wherein said cervical support engages the cervical spinal region of a person laying against said cervical support.

19. The apparatus of claim 10, wherein said means for selectively detaching is comprised of mechanically engageable hook and loop fasteners.

20. The apparatus of claim 10, wherein said cervical support engages the neck region of a person laying on said apparatus, said joining means engages the thoracic, mid-back region of said person, and said lumbar support engages the lower back of said person.

21. The apparatus of claim 10, wherein said attaching means are elastic devices adapted for wrapping around said furniture.

22. The apparatus of claim 21, wherein said attaching means further comprise of a hook and bungee material.

* * * * *